US012735780B2

(12) United States Patent
Schwarzenbrunner et al.

(10) Patent No.: US 12,735,780 B2
(45) **Date of Patent: *Sep. 15, 2026**

(54) ZINC OR ZINC-ALLOY COATED STRIP OR STEEL WITH IMPROVED ZINC ADHESION

(71) Applicant: VOESTALPINE STAHL GMBH, Linz (AT)

(72) Inventors: Michael Schwarzenbrunner, Walding (AT); Katharina Steineder, Linz (AT)

(73) Assignee: VOESTALPINE STAHL GMBH, Linz (AT)

( * ) Notice: Subject to any disclaimer, the term of this patent is extended or adjusted under 35 U.S.C. 154(b) by 410 days.

This patent is subject to a terminal disclaimer.

(21) Appl. No.: 18/269,262

(22) PCT Filed: Dec. 23, 2021

(86) PCT No.: PCT/EP2021/087607

§ 371 (c)(1),
(2) Date: Jun. 22, 2023

(87) PCT Pub. No.: WO2022/136689

PCT Pub. Date: Jun. 30, 2022

(65) Prior Publication Data

US 2024/0117455 A1 Apr. 11, 2024

(30) Foreign Application Priority Data

Dec. 23, 2020 (SE) ..... 2051557-3
Dec. 23, 2020 (SE) ..... 2051558-1

(51) Int. Cl.

| | |
|---|---|
| ***C22C 38/02*** | (2006.01) |
| ***C21D 1/18*** | (2006.01) |
| ***C21D 1/76*** | (2006.01) |
| ***C21D 1/84*** | (2006.01) |
| ***C21D 6/00*** | (2006.01) |
| ***C21D 8/02*** | (2026.01) |
| ***C21D 8/021*** | (2026.01) |
| ***C21D 8/0221*** | (2026.01) |
| ***C21D 8/0247*** | (2026.01) |
| ***C21D 8/0278*** | (2026.01) |
| ***C21D 9/52*** | (2006.01) |
| ***C22C 38/00*** | (2006.01) |
| ***C22C 38/06*** | (2006.01) |
| ***C22C 38/38*** | (2006.01) |
| ***C23C 2/02*** | (2006.01) |
| ***C23C 2/06*** | (2006.01) |
| ***C23C 2/28*** | (2006.01) |
| ***C23C 2/40*** | (2006.01) |

(52) U.S. Cl.

CPC ..... *C23C 2/024* (2022.08); *C21D 1/18* (2013.01); *C21D 1/76* (2013.01); *C21D 1/84* (2013.01); *C21D 6/002* (2013.01); *C21D 6/005* (2013.01); *C21D 6/008* (2013.01); *C21D 8/02* (2013.01); *C21D 8/021* (2013.01); *C21D 8/0226* (2013.01); *C21D 8/0236* (2013.01); *C21D 8/0263* (2013.01); *C21D 8/0278* (2013.01); *C21D 9/52* (2013.01); *C22C 38/001* (2013.01); *C22C 38/02* (2013.01); *C22C 38/06* (2013.01); *C22C 38/38* (2013.01); *C23C 2/02* (2013.01); *C23C 2/0222* (2022.08); *C23C 2/0224* (2022.08); *C23C 2/06* (2013.01); *C23C 2/28* (2013.01); *C23C 2/40* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C22C 38/001; C22C 38/06; C22C 38/42; C22C 38/50; C22C 38/54; C22C 38/58; C21D 8/0236; C21D 2211/001; C21D 2211/002

See application file for complete search history.

(56) References Cited

U.S. PATENT DOCUMENTS

| | | | |
|---|---|---|---|
| 10,113,223 | B2 | 10/2018 | Kawata et al. |
| 2010/0139816 | A1 | 6/2010 | Hanlon et al. |
| 2014/0234655 | A1 | 8/2014 | Takashima et al. |
| 2014/0377582 | A1 | 12/2014 | Azuma et al. |
| 2017/0107591 | A1 | 4/2017 | Takashima et al. |
| 2017/0260599 | A1 | 9/2017 | Velasquez et al. |
| 2018/0265943 | A1 | 9/2018 | Park et al. |
| 2018/0371597 | A1 | 12/2018 | Hebesberger et al. |
| 2019/0338385 | A1 | 11/2019 | Pipard et al. |

(Continued)

FOREIGN PATENT DOCUMENTS

| | | | |
|---|---|---|---|
| CN | 102639739 | A | 8/2012 |
| CN | 102666923 | A | 9/2012 |

(Continued)

OTHER PUBLICATIONS

Chinese Office Action dated Apr. 18, 2025, for Chinese Patent Application No. 202180093348.8.

(Continued)

*Primary Examiner* — Adam Krupicka
(74) *Attorney, Agent, or Firm* — KARCESKI IP LAW, PLLC

(57) ABSTRACT

A zinc or zinc-alloy coated rolled steel strip or sheet includes (in wt. %) 0.08-0.28 C, 1.4-4.5 Mn, 0.01-0.5 Cr, 0.01-2.5 Si, 0.01-2.0 Al. The steel has a tensile strength of 950-1550 MPa, a yield strength of 350-1400 MPa, a yield ratio≥0.35, and Ri/t≤4. The microstructure includes ≥40 tempered martensite+bainite, ≤30 fresh martensite, 5-20 retained austenite, and ≤35 polygonal ferrite. The hydrogen concentration is less than 0.2 ppm in the steel.

15 Claims, 1 Drawing Sheet

(56) References Cited

U.S. PATENT DOCUMENTS

| | | | |
|---|---|---|---|
| 2019/0338388 | A1 | 11/2019 | Pipard et al. |
| 2020/0157666 | A1 | 5/2020 | Sakakibara et al. |
| 2020/0181729 | A1 | 6/2020 | Pipard et al. |
| 2020/0270713 | A1 | 8/2020 | Gospodinova et al. |
| 2020/0291499 | A1 | 9/2020 | Yoshitomi et al. |
| 2020/0347473 | A1 | 11/2020 | Kohsaka et al. |
| 2022/0090248 | A1 | 3/2022 | Yokoyama et al. |

FOREIGN PATENT DOCUMENTS

| | | | |
|---|---|---|---|
| CN | 103649343 | A | 3/2014 |
| CN | 104870676 | A | 8/2015 |
| CN | 105940134 | A | 9/2016 |
| CN | 107109575 | A | 8/2017 |
| CN | 107148487 | A | 9/2017 |
| CN | 107406930 | A | 11/2017 |
| CN | 108779524 | A | 11/2018 |
| CN | 110268083 | A | 9/2019 |
| CN | 110892087 | A | 3/2020 |
| CN | 111386358 | A | 7/2020 |
| CN | 111433379 | A | 7/2020 |
| CN | 112048680 | A | 12/2020 |
| EP | 2831299 | A1 | 2/2015 |
| EP | 2707514 | B1 | 11/2016 |
| EP | 3653738 | A1 | 5/2020 |
| EP | 3686293 | A1 | 7/2020 |
| JP | 2015078395 | A | 4/2015 |
| JP | 6777267 | B1 | 10/2020 |
| KR | 20080062120 | A | 7/2008 |
| KR | 20190087506 | | 7/2019 |
| KR | 20200075949 | A | 6/2020 |
| KR | 20200076789 | A | 6/2020 |
| WO | 2018116155 | A1 | 6/2018 |
| WO | 2019122963 | A1 | 6/2019 |
| WO | 2019123043 | A1 | 6/2019 |
| WO | 2019181950 | A1 | 9/2019 |
| WO | 2020067752 | A1 | 4/2020 |
| WO | 2020151856 | A1 | 7/2020 |
| WO | 2020162556 | A1 | 8/2020 |
| WO | 2020162561 | A1 | 8/2020 |
| WO | 2020170542 | A1 | 8/2020 |
| WO | 2020184154 | A1 | 9/2020 |
| WO | 2020245626 | A1 | 12/2020 |

OTHER PUBLICATIONS

Chinese Office Action dated Jul. 28, 2025, for Chinese Patent Application No. 202180093348.8.

International Preliminary Report on Patentability dated Apr. 3, 2023, for International Patent Application No. PCT/EP2021/087599.

International Preliminary Report on Patentability dated Mar. 29, 2023, for International Patent Application No. PCT/EP2021/087596.

International Preliminary Report on Patentability dated Mar. 31, 2023, for International Patent Application No. PCT/EP2021/087603.

International Search Report and Written Opinion dated Apr. 4, 2022, for International Patent Application No. PCT/EP2021/087599.

International Search Report dated Apr. 4, 2022, for International Patent Application No. PCT/EP2021/087596.

International Search Report dated Apr. 4, 2022, for International Patent Application No. PCT/EP2021/087603.

International Preliminary Report on Patentability dated Apr. 4, 2023, for International Patent Application No. PCT/EP2021/087607.

International Search Report dated Mar. 28, 2022, for International Patent Application No. PCT/EP2021/087607.

Chinese Office Action dated Jan. 4, 2026, for Chinese Patent Application No. 202180093343.5.

Chinese Office Action dated Oct. 17, 2025, for Chinese Patent Application No. 202180093332.7.

Korean Office Action dated Apr. 27, 2026, for Korean Patent Application No. 10-2023-7025167.

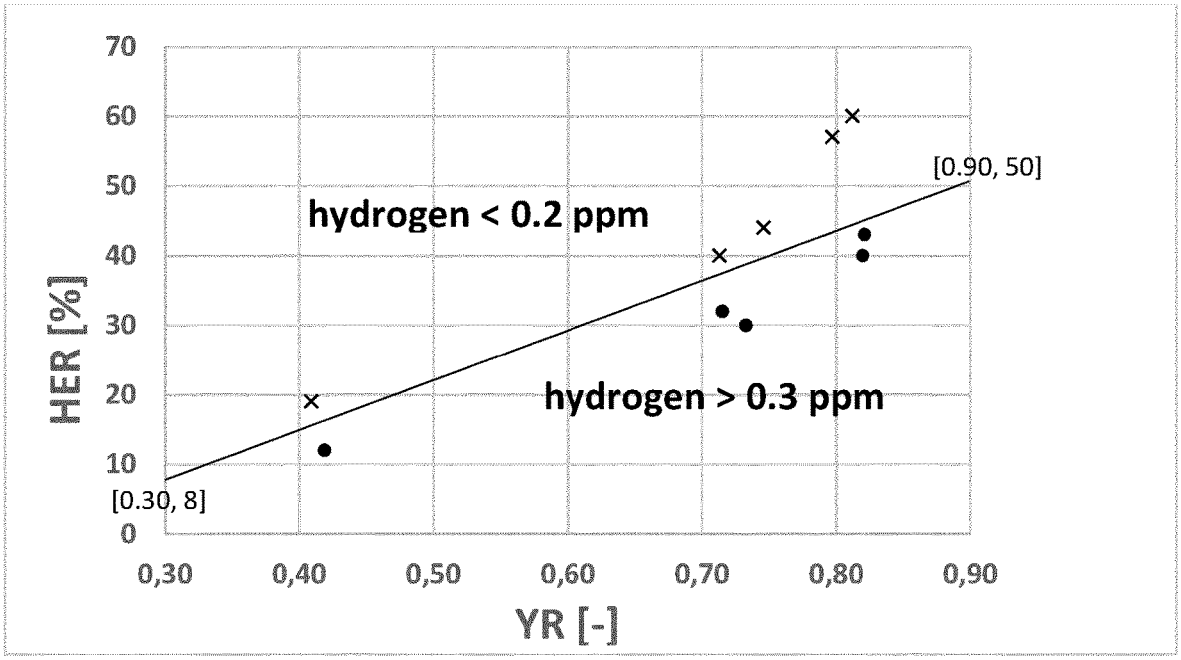
70
60
50
40
30
20
10
0
HER [%]
0,30
0,40
0,50
0,60
0,70
0,80
0,90
YR [-]
hydrogen < 0.2 ppm
hydrogen > 0.3 ppm
[0.90, 50]
[0.30, 8]

ZINC OR ZINC-ALLOY COATED STRIP OR STEEL WITH IMPROVED ZINC ADHESION

CROSS-REFERENCE TO RELATED APPLICATION(S)

This is a National Stage Entry into the United States Patent and Trademark Office from International Patent Application No. PCT/EP2021/087607, filed on Dec. 23, 2021, which relies on and claims priority to Swedish Patent Application No. 2051557-3, filed on Dec. 23, 2020, and Swedish Patent Application No. 2051558-1, filed on Dec. 23, 2020, the entire contents of all of which are incorporated herein by reference.

FIELD OF THE INVENTION

The present invention relates to a cold rolled steel strip or sheet coated with zinc or a zinc-alloy and a method of producing a zinc or zinc-alloy coated steel strip or sheet. The steel strip or sheet is suitable for applications in automobiles.

BACKGROUND OF THE INVENTION

For a great variety of applications increased strength levels are a pre-requisite for light-weight constructions in particular in the automotive industry, since car body mass reduction results in reduced fuel consumption.

Automotive body parts are often stamped out of sheet steels, forming complex structural members of thin sheet. However, such parts cannot be produced from conventional high strength steels, because of a too low formability of the complex structural parts. For this reason, multi-phase Transformation Induced Plasticity aided steels (TRIP steels) have gained considerable interest in the last years, in particular for use in auto body structural parts and as seat frame materials.

TRIP steels possess a multi-phase microstructure, which includes a meta-stable retained austenite phase, which is capable of producing the TRIP effect. When the steel is deformed, the austenite transforms into martensite, which results in remarkable work hardening. This hardening effect acts to resist necking in the material and postpones failure in sheet forming operations. The microstructure of a TRIP steel can greatly alter its mechanical properties.

TRIP-assisted steels have been known for long and attracted a lot of interest. The TRIP effect ensured by the strain-induced transformation of metastable retained austenite islands into martensite, remarkably improves their global ductility. Depending on the matrix of the steel, it may allow additionally excellent stretch flangeability or high uniform elongations.

Automotive parts are galvanized, galvannealed to improve corrosion resistance.

There is demand for >950 MPa steel sheet or strip having an excellent surface quality, in particular a zinc coated steel sheet or strip having a high Hole Expansion Ratio. Further desirable properties are improved bendability and reduced susceptibility to Liquid metal embrittlement.

US2020/291499 A1 teaches that residual austenite is set to less than 5% from the viewpoint of reducing the amount of diffusible hydrogen in the steel. The maximum amount of residual austenite in the examples is 2%.

WO 2020/170542 A1 disclose that retained austenite should be 5% or less, since retained austenite has high hydrogen concentration. This induces problems for punching and bending. According to WO 2020/170542 A1 the retained austenite is preferably 4.0% or less and more preferably 3.5% or less. The largest value of Table 3 in WO 2020/170542 A1 is a retained austenite of 2.5%.

SUMMARY OF THE INVENTION

The present invention is directed to the producing a zinc or zinc-alloy coated steel strip or sheet cold rolled steels having a tensile strength of at least 950 MPa and an excellent formability, wherein it should be possible to produce the steel sheets/strips on an industrial scale in a Continuous Annealing Line (CAL) and in a Hot Dip Galvanizing Line (HDGL).

The invention aims at providing a zinc or zinc-alloy coated steel strip or sheet, and a production method for it, having a composition and microstructure that can be processed to complicated high strength structural members, where the Hole Expansion Ratio (HER) is of importance. The careful selection of alloying elements and process parameters, particularly relating to the atmosphere during soaking reduces the hydrogen content of the steel. The lower hydrogen content in the steel improves the Hole Expansion Ratio, bendability, and reduces the risk of liquid metal embrittlement.

The zinc or zinc-alloy coated cold rolled steel strip or sheet, a) having a composition comprising of (in wt. %):

| | |
|---|---|
| C | 0.08-0.28 |
| Mn | 1.4-4.5 |
| Cr | 0.01-0.5 |
| Si | 0.01-2.5 |
| Al | 0.01-2.0 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities;

b) fulfilling the following conditions:

| | |
|---|---|
| TS tensile strength ($R_m$) | 950-1550 MPa |
| YS yield strength ($R_{p0.2}$) | 350-1400 MPa |
| YR yield ratio ($R_{p0.2}/R_m$) | ≥0.35 |
| bendability (Ri/t) | ≤4 |

c) having a multiphase microstructure comprising (in vol %)

tempered martensite+

| | |
|---|---|
| bainite | ≥40 |
| fresh martensite | ≤30 |
| retained austenite | 2-20 |
| polygonal ferrite | ≤35; and |

d) having a hydrogen concentration of less than 0.2 ppm in the steel; and e) having a zinc or zinc-alloy coating.

The method of producing a zinc or zinc-alloy coated steel strip or sheet comprising the following steps:

i. providing a cold rolled steel sheet or strip having a nominal composition consisting of (in wt. %):

| | |
|---|---|
| C | 0.08-0.28 |
| Mn | 1.4-4.5 |
| Cr | 0.01-0.5 |
| Si | 0.01-2.5 |
| Al | 0.01-2.0 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities;

ii. heating the sheet or strip to a temperature in the range of 650-900° C. in a reducing atmosphere with an optional change of atmosphere to an oxidizing atmosphere in a temperature range lying between 650 and 900° C.;

iii. soaking the sheet or strip at temperature in the range of 780-1000° C. for a duration of 40 s to 180 s in a nitrogen atmosphere containing <2 vol. % hydrogen;

iv. cooling the strip or sheet at a rate in the range of 10-400° C./s to a temperature between 200 and 500° C. followed by isothermal holding for 50-10000 s before coating;

v. coating the strip or sheet with a zinc or a zinc-alloy coating; and vi. optionally galvannealing to alloy the coating into the steel strip.

BRIEF DESCRIPTION OF THE DRAWINGS

FIG. 1 shows a graph with the inventive samples above a line and the reference samples below a line.

DETAILED DESCRIPTION OF EMBODIMENT(S) OF THE INVENTION

The invention is described in the paragraphs that follow.

Composition

The steel sheet or strip has a composition consisting of the following alloying elements (in wt. %):

| | |
|---|---|
| C | 0.08-0.28 |
| Mn | 1.4-4.5 |
| Cr | 0.01-0.5 |
| Si | 0.01-2.5 |
| Al | 0.01-2.0 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities.

The importance of the separate elements and their interaction with each other as well as the limitations of the chemical ingredients of the claimed alloy are briefly explained in the following. All percentages for the chemical composition of the steel are given in weight % (wt. %) throughout the description. Upper and lower limits of the individual elements can be freely combined within the limits set out in the claims. The arithmetic precision of the numerical values can be increased by one or two digits for all values given in the present application. Hence, a value of given as e.g. 0.1% can also be expressed as 0.10 or 0.100%. The amounts of the microstructural constituents are given in volume % (vol. %).

C: 0.08-0.28%

C stabilizes the austenite and is important for obtaining sufficient carbon within the retained austenite phase. C is also important for obtaining the desired strength level. Generally, an increase of the tensile strength in the order of 100 MPa per 0.1% C can be expected. When C is lower than 0.08% it is difficult to attain a tensile strength of 950 MPa. If C exceeds 0.28%, then the weldability is impaired. The upper limit may thus be 0.26, 0.24, 0.22, 0.20 or 0.18%. The lower limit may be 0.10, 0.12, 0.14, or 0.16%.

Mn: 1.4-4.5%

Manganese is a solid solution strengthening element, which stabilises the austenite by lowering the $M_s$ temperature and prevents ferrite and pearlite to be formed during cooling. In addition, Mn lowers the $A_{c3}$ temperature and is important for the austenite stability. At a content of less than 1.4% it might be difficult to obtain the desired amount of retained austenite, a tensile strength of 950 MPa and the austenitizing temperature might be too high for conventional industrial annealing lines. In addition, at lower contents it may be difficult to avoid the formation of polygonal ferrite. However, if the amount of Mn is higher than 4.5%, problems with segregation may occur because Mn accumulates in the liquid phase and causes banding, resulting in a potentially deteriorated workability. The upper limit may therefore be 4.2, 4.0, 3.8, 3.6, 3.4, 3.2, 3.0, 2.8, 2.6, or 2.4%. The lower limit may be 1.4, 1.5, 1.7, 1.9, 2.1, 2.3, or 2.5%.

Cr: 0.01-0.5%

Cr is effective in increasing the strength of the steel sheet. Cr is an element that forms ferrite and retards the formation of pearlite and bainite. The $A_{c3}$ temperature and the $M_s$ temperature are only slightly lowered with increasing Cr content. Cr results in an increased amount of stabilized retained austenite. When above 0.5% it may impair surface finish of the steel, and therefore the amount of Cr is limited to 0.5%. The upper limit may be 0.45 or 0.40, 0.35, 0.30 or 0.25%. The lower limit may be 0.01, 0.03, 0.05, 0.07, 0.10, 0.15, 0.20 or 0.25%. Preferably, a deliberate addition of Cr is not conducted according to the present invention.

Si: 0.01-2.5%

Si acts as a solid solution strengthening element and is important for securing the strength of the thin steel strip. Si suppresses the cementite precipitation and is essential for austenite stabilization. However, if the content is too high, then too much silicon oxides will form on the strip surface, which may lead to cladding on the rolls in the CAL and, as a result there of, to surface defects on subsequently produced steel sheets. The upper limit is therefore 2.5% and may be restricted to 2.4, 2.2, 2.0, 1.8 or 1.6%. The lower limit may be 0.01, 0.05, 0.1, 0.2, 0.3, 0.4, 0.60, 0.80 or 1.0%.

Al: 0.01-2.0%

Al promotes ferrite formation and is also commonly used as a deoxidizer. Al, like Si, is not soluble in the cementite and therefore it considerably delays the cementite formation during bainite formation. In addition, galvanization and reduced susceptibility to Liquid metal embrittlement can be improved. Additions of Al result in a remarkable increase in the carbon content in the retained austenite. The upper level may be 2.0, 1.8, 1.7, 1.6, 1.5, 1.4, 1.3, 1.2, 1.1%. The lower limit may be set to 0.01, 0.02, 0.03, 0.04, 0.05, 0.06, 0.07, 0.08, 0.09, or 0.1%.

For some applications it may also be suitable to limit Al to 0.01-0.6%. Here the upper limit can may be set to 0.5, 0.4, 0.3, 0.2, or 0.1% and the lower limit may be set to 0.01, 0.02, 0.03, 0.04, 0.05, 0.06, 0.07, 0.08, 0.09, or 0.1%. If Al is used for deoxidation only then the upper level may then be 0.09, 0.08, 0.07 or 0.06%. For securing a certain effect the lower level may set to 0.03 or 0.04%.

For other applications it may be suitable to limit Al to 0.5-2.0%. Here the upper limit can further be set to 2.0, 1.8, 1.7, 1.6, 1.5, 1.4, 1.3, 1.2, or 1.1% and the lower limit may be set to 0.5, 0.6, 0.7, 0.8, or 0.9%.

Si+Al≥0.1%-2%

Si and Al suppress the cementite precipitation during bainite formation. Their combined content is therefore preferably at least 0.1%. The lower limit may be set to 0.1, 0.2, 0.3, 0.4, or 0.5%. The upper limit may be set to 2%.

Si+Al+Cr≥0.4%-2.5%

A certain amount of these elements is beneficial for the formation of austenite. Their combined content should therefore be at least ≥0.4%. The lower limit can be 0.5, 0.6 or 0.7%. The upper limit may be set to 2.5%.

Mn+Cr 1.7-5.0%

Manganese and Chromium affects the hardenability of the steel. Their combined content should therefore be within the range of 1.7-5.0%.

Optional Elements

Mo≤0.5%

Molybdenum is a powerful hardenability agent. It may further enhance the benefits of NbC precipitates by reducing the carbide coarsening kinetics. The steel may therefore contain Mo in an amount up to 0.5%. The upper limit may be restricted to 0.4, 0.3, 0.2, or 0.1%. A deliberate addition of Mo is not necessary according to the present invention. The upper limit may therefore be restricted to ≤0.01%.

Nb: ≤0.1%

Nb is commonly used in low alloyed steels for improving strength and toughness, because of its influence on the grain size. Nb increases the strength elongation balance by refining the matrix microstructure and the retained austenite phase due to precipitation of NbC. The steel may contain Nb in an amount of ≤0.1%. The upper limit may be restricted to 0.09, 0.07, 0.05, 0.03, or 0.01%. A deliberate addition of Nb is not necessary according to the present invention. The upper limit may therefore be restricted to ≤0.004%.

V: ≤0.1%

The function of V is similar to that of Nb in that it contributes to precipitation hardening and grain refinement. The steel may contain V in an amount of ≤0.1%. The upper limit may be restricted to 0.09, 0.07, 0.05, 0.03, or 0.01%. A deliberate addition of V is not necessary according to the present invention. The upper limit may therefore be restricted to ≤0.01%.

Ti: ≤0.1%

Ti is commonly used in low alloyed steels for improving strength and toughness, because of its influence on the grain size by forming carbides, nitrides or carbonitrides. In particular, Ti is a strong nitride former and can be used to bind the nitrogen in the steel. However, the effect tends to be saturated above 0.1%. The upper limit may be restricted to 0.09, 0.07, 0.05, 0.03, or 0.01%. A deliberate addition of Ti is not necessary according to the present invention. The upper limit may therefore be restricted to ≤0.005%.

Ca≤0.05

Ca may be used for the modification of the non-metallic inclusions. The upper limit is 0.05% and may be set to 0.04, 0.03, 0.01%. A deliberate addition of Ca is not necessary according to the present invention. The upper limit may therefore be restricted to ≤0.005%.

Impurities

Cu: ≤0.06%

Cu is an undesired impurity element that is restricted to ≤0.06% by careful selection of the scrap used.

Ni: ≤0.08%

Ni is also an undesired impurity element that is restricted to ≤0.08% by careful selection of the scrap used.

B: ≤0.0006%

B is an undesired impurity element that is restricted to ≤0.006% by careful selection of the scrap used. B increases hardness but may come at a cost of reduced bendability and is therefore not desirable in the present suggested steel. B may further make scrap recycling more difficult, and an addition of B may also deteriorate workability. A deliberate addition of B is therefore not desired according to the present invention.

Other impurity elements may be comprised in the steel in normal occurring amounts. However, it is preferred to limit the amounts of P, S, As, Zr, Sn to the following optional maximum contents:

P: ≤0.02%
S: ≤0.005%
As≤0.010%
Zr≤0.006%
Sn≤0.015%

It is also preferred to control the nitrogen content to the range:

N: ≤0.015%, preferably 0.003-0.008% In this range a stable fixation of the nitrogen can be achieved.

Oxygen and hydrogen can further be limited to

O: ≤0.0003

Microstructure

The microstructural constituents are in the following expressed in volume % (vol. %).

The cold rolled steel sheets of the present invention have a microstructure comprising at least 40% tempered martensite (TM) and bainite (B). And further, at most 30% fresh martensite (FM) and at most 35% polygonal ferrite (PF).

Retained austenite is a prerequisite for obtaining the desired TRIP effect. The amount of retained austenite should therefore be in the range of 2-20%, preferably 5-15%. The amount of retained austenite was measured by means of the saturation magnetization method described in detail in Proc. Int. Conf. on TRIP-aided high strength ferrous alloys (2002), Ghent, Belgium, p. 61-64.

Depending on the Al content the tempered martensite (TM) and bainite (B), the fresh martensite (FM) and the polygonal ferrite (PF) can be further limited as described below.

A Microstructure of Steels Having Al in the Range 0.01-0.6 can Further be Limited.

The microstructure comprising at least 50% tempered martensite (TM) and bainite (B). The lower limit may restrict to at least 60, 70%, 75%, or 80%.

And further, at most 10% fresh martensite (FM). The upper limit may be restricted 8% or 5%. Small amounts of fresh martensite may improve edge flangeability and local ductility. The lower limit may be restricted 1% or 2%. These un-tempered martensite particles are often in close contact with the retained austenite particles, and they are therefore often referred to as martensite-austenite (MA) particles.

Polygonal ferrite (PF) should further be limited to ≤20%, preferably ≤10%, ≤5%, ≤3% or ≤1%. Most preferably, the low Al steel is free from PF.

Retained austenite as described above.

A Microstructure of Steels Having Al in the Range of 0.5-2.0 can Further be Limited.

The microstructure comprising at least 40% tempered martensite (TM) and bainite (B).

And further, 10-30% fresh martensite (FM). The upper limit may be restricted 28, 26, 24 or 22%. The lower limit may be restricted 12, 14, 16 or 18%.

And further 10-35% polygonal ferrite (PF). Upper limit may be 30 or 25%. Lower limit may be 5 or 20%.

Retained austenite as described above.

Mechanical Properties

The mechanical properties of the claimed steel are important, and the following requirements should be fulfilled:

| | |
|---|---|
| TS tensile strength ($R_m$) | 950-1550 MPa |
| YS yield strength ($R_{p0.2}$) | 350-1400 MPa |
| YR yield ratio ($R_{p0.2}/R_m$) | ≥0.35 |
| bendability (Ri/t) | ≤4 |

The $R_m$, $R_{p0.2}$ values are derived according to the European norm EN 10002 Part 1, wherein the samples are taken in the longitudinal direction of the strip.

The bendability is evaluated by the ratio of the limiting bending radius (Ri), which is defined as the minimum bending radius with no occurrence of cracks, and the sheet thickness, (t). For this purpose, a 90° V-shaped block is used to bend the steel sheet in accordance with JIS Z2248. The value obtained by dividing the limit bending radius with the thickness (Ri/t) should be less than 4, preferably less than 3. Using steam injection to raise CO above 10000 ppm during soaking can improve the bendability by 10-30% compared to the same grade without steam injection.

Bendability may be ≤4, ≤3.5, ≤3, ≤2.5, or ≤2. Lower limit may be 1, 1.5, or 2.

The yield ratio YR is defined by dividing the yield strength YS with the tensile strength TS.

The hydrogen concentration is less than 0.2 ppm in the steel. The dissolution of hydrogen in both ferrite and austenite has been investigated and the studies reveals that for face centred cubic crystal structure like austenite, hydrogen is favoured at octahedral sites and the dissolution energy is smaller than that in body centred cubic crystal structures like ferrite and martensite and this is the explanation for larger solubility of hydrogen in austenite than in ferrite. After punching operations, which introduce a great amount of dislocations, the hydrogen diffuses to the edges and worsens the local ductility (e.g.: HER).

The hole expanding ratio (λ) HER may be ≥15, ≥25, ≥30, ≥40, or ≥50. Upper limit may be 90, 80, or 70.

Preferably the hole expansion ratio HER, and the yield ratio YR are above the line through the coordinates A and B of FIG. 1, where HER in % (y-axle) is plotted vs YR (x-axle), and where A is [0.30, 8] and B is [0.90, 50].

The hole expanding ratio (λ) is determined by the hole expanding test according to ISO/WD 16630:2009 (E). In this test a conical punch having an apex of 60° is forced into a 10 mm diameter punched hole made in a steel sheet having the size of 100×100 $mm^2$. The test is stopped as soon as the first crack is determined, and the hole diameter is measured in two directions orthogonal to each other. The arithmetic mean value is used for the calculation.

The hole expanding ratio (λ) in % is calculated as follows:

$$\lambda=(Dh-Do)/Do\times 100$$

wherein Do is the diameter of the hole at the beginning (10 mm) and Dh is the diameter of the hole after the test.

Depending on the Al content the mechanical properties can be further limited.

Mechanical properties of steels having Al in the range 0.01-0.6 can further be limited to:

| | |
|---|---|
| TS tensile strength ($R_m$) | 950-1550 MPa |
| YS yield strength ($R_{p0.2}$) | 550-1400 MPa |
| YR yield ratio ($R_{p0.2}/R_m$) | ≥0.50 |
| bendability (Ri/t) | ≤4; |

The lower limit for YR of steels having Al in the range of 0.01-0.6, can further be set to 0.70, 0.75, 0.76, 0.77, or 0.78.

Mechanical properties of steels having Al in the range of 0.5-2.0 can further be limited to:

| | |
|---|---|
| TS tensile strength ($R_m$) | 950-1350 MPa |
| YS yield strength ($R_{p0.2}$) | 350-1150 MPa |
| YR yield ratio ($R_{p0.2}/R_m$) | ≥0.35 |
| bendability (Ri/t) | ≤4 |

Optional Decarburized Zone and Microhardness

Through steam injection during soaking it is possible to decarburize the steel. The steel may therefore be provided with a decarburized zone in which the carbon content at a depth of 20 μm is not more than 75% by weight of the carbon content in the middle of the steel strip. The carbon content at depth 20 μm can further be set to not more than 50%, 40% or 30% of the carbon content in the middle of the steel strip.

The microhardness at a depth of 20 μm is not higher than 75% of the microhardness in the middle of the steel strip. The microhardness at a depth of 20 μm can further be set to not higher than 70%, 60% or 50% of the microhardness in the middle of the steel strip.

The decarburised zone improves zinc adhesion and bendability of the steel.

Zinc Coating

The steel sheet or strip comprises a zinc or a zinc-alloy coating. The coating can be applied by Hot Dip Galvanizing (GI), Galvannealing (GA) or through Electrogalvanizing (EG).

A zinc alloy coating may comprise in weight %:

at least one of:

| | |
|---|---|
| Mg | 0.1-10 |
| Al | 0.1-10 |
| Sn | 1-10 |

Balance Zn and impurities.

A galvannealed coating can contain 5-20 wt. % of diffused Fe.

Zinc Adhesion

The steel may have a Zn-adhesion 3 or less as determined by a drop-ball impact test according to SEP 1931: Prüfung der Haftung von Zinküberzügen auf feuerverzinktem Feinblech, Kugelschlagprüfung, 1991.

Through steam injection during soaking it is possible to decarburize the steel and improve zinc adhesion. Steam injection may enable a Zn-adhesion of 1 or 2.

Production of Cold Rolled Strip

The steel can be produced by making steel slabs of the conventional metallurgy by converter melting and secondary metallurgy with the composition suggested above. The slabs are hot rolled in austenitic range to a hot rolled strip. Preferably by reheating the slab to a temperature between 1000° C. and 1280° C., rolling the slab completely in the austenitic range wherein the hot rolling finishing temperature is greater than or equal to 850° C. to obtain the hot rolled steel strip. Thereafter the hot rolled strip is coiled at a coiling temperature in the range of 500-700° C. Optionally subjecting the coiled strip to a scale removal process, such as pickling. The coiled strip is thereafter batch annealed at a temperature in the range of 500–650° C., preferably 550-650° C., for a duration of 5-30 h. Thereafter cold rolling the batch annealed steel strip with a reduction rate between 35 and 90%, preferably around 40-60% reduction.

Annealing and Coating of Cold Rolled Strip

The cold rolled strips can e.g. be treated in a Continuously Annealing Line (CAL) and subsequent Continuous Electroplating Line (CEL) or in a Hot Dip Galvanizing Line (HDGL).

The annealing and coating include the steps:

i) Providing a cold rolled steel sheet or strip having a nominal composition as described in the section Composition or the section Exemplary compositions and mechanical properties.

ii) heating the sheet or strip to a temperature in the range of 650-900° C. in a reducing atmosphere with an optional change of atmosphere to an oxidizing atmosphere in a temperature range lying between 650 and 900° C. The heating can be e.g. be done in a heating furnace such as a Direct Fired Furnace (DFF) or Non-Oxidizing Furnace (NOF).

iii) Soaking the sheet or strip at temperature in the range of 780-1000° C. for a duration of 40 s to 180 s in a nitrogen atmosphere containing <2 vol. % hydrogen. The soaking furnace can e.g. be radiant tube furnace.

The soaking temperature is a preferably in the range of 830-890° C.

The soaking temperature is preferably above $A_{c3}$ as defined by: $A_{c3}=910-203*C^{1/2}-15.2\ Ni-30\ Mn+44.7\ Si+104\ V+31.5\ Mo+13.1\ W$. The soaking temperature may be least $A_{c3}+20°$ C. or at least $A_{c3}+30°$ C.

The upper limit of hydrogen may be 1.9, 1.7, 1.5, 1.4, 1.3, 1.2, 1.1, or 1.0%. The lower limit of hydrogen may be 0.1, 0.3, 0.5%. The atmosphere may be essentially void of hydrogen.

Optionally injecting steam during the soaking step to bring CO>1 vol. % and to create a decarburized zone. The CO content can e.g. be controlled by measuring the CO level in the exhaust gases from the soaking furnace. The upper limit of CO may be 2 or 1.5%.

iv) Cooling the strip or sheet at a rate in the range of 10-400° C./s to a temperature between 200 and 500° C. followed by isothermal holding for 50-10000 s before coating. The cooling of the strip can e.g. be done by slow jet cooling followed by rapid jet cooling.

The end temperature of cooling and the holding temperature may be above or below $M_S$. $M_S$ can be defined by the formula: $M_S=692-502*(C+0.68N)^{0.5}-37*Mn-14*Si+20*Al-11*Cr$.

The lower time of the isothermal holding may be set to 50, or 100 s. The upper time of may be 10000, 5000, 1000, or 500 s. The lower temperature of the isothermal holding may be 200, 250, 300, or 330° C. The upper temperature may be 500, 450, or 400° C.

v) Coating the strip or sheet with a zinc or a zinc-alloy coating. The coating can e.g. be applied by Hot Dip Galvanizing (GI), Galvannealing (GA), or Electrogalvanizing (EG).

vi) Optionally galvannealing to alloy the coating into the steel strip. If the coating is applied with Hot Dip Galvanizing, the strip or sheet can be annealed to alloy the coating into the steel strip or sheet.

The galvannealing may be performed at temperatures in the range of 450-600° C.

Exemplary Compositions and Mechanical Properties

The microstructure and the mechanical properties of example 1-5 can be limited according to the restrictions disclosure for steels having Al in the range of 0.01-0.6 as discussed above, whereas the microstructure and the mechanical properties of example 6 and 7 can be limited according to the restrictions disclosure for steels having Al in the range of 0.5-2.0 as discussed above.

According to a first example the steel:

a) having a composition comprising of (in wt. %):

| | |
|---|---|
| C | 0.08-0.28 |
| Mn | 1.4-4.5 |
| Cr | 0.01-0.5 |
| Si | 0.01-2.5 |
| Al | 0.01-0.6 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities;

b) fulfilling at least one of the following conditions:

| | |
|---|---|
| TS tensile strength ($R_m$) | 950-1550 MPa |
| YS yield strength ($R_{p0.2}$) | 550-1400 MPa |
| YR yield ratio ($R_{p0.2}/R_m$) | ≥0.50 |
| bendability (Ri/t) | ≤4 |
| HER | ≥25. |

According to a second example the steel:

a) having a composition comprising of (in wt. %):

| | |
|---|---|
| C | 0.08-0.16 |
| Mn | 2.0-3.0 |
| Cr | 0.1-0.5 |
| Si | 0.5-1.2 |
| Al | 0.01-0.5 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities; and b) fulfilling at least one of the following conditions:

TS tensile strength ($R_m$) 950-1150 MPa

YS yield strength ($R_{p0.2}$) 750-1000 MPa

YR yield ratio ($R_{p0.2}/R_m$)≥0.70 bendability (Ri/t)≤2

HER≥50.

According to a third example the steel:

a) having a composition comprising of (in wt. %):

| | |
|---|---|
| C | 0.15-0.25 |
| Mn | 1.0-2.0 |
| Cr | 0.1-0.5 |
| Si | 0.1-0.5 |
| Al | 0.01-0.5 |
| Si + Al | ≥0.1 |
| Si + Al + Cr | ≥0.4 |
| Nb | ≤0.1 |
| Ti | ≤0.1 |

-continued

| | |
|---|---|
| Mo | ≤0.5 |
| Ca | ≤0.05 |
| V | ≤0.1 |

balance Fe apart from impurities; and b) fulfilling at least one of the following conditions:

| | |
|---|---|
| TS tensile strength ($R_m$) | 1300-1550 MPa |
| YS yield strength ($R_{p0.2}$) | 1000-1300 MPa |
| YR yield ratio ($R_{p0.2}/R_m$) | ≥0.70 |
| bendability (Ri/t) | ≤4 |
| HER | ≥50. |

According to a fourth example the steel:

a) having a composition comprising of (in wt. %):

| | |
|---|---|
| C | 0.15-0.25 |
| Mn | 2.0-3.0 |
| Cr | 0.1-0.5 |
| Si | 1-2.0 |
| Al | 0.01-0.5 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities; and b) fulfilling at least one of the following conditions:

| | |
|---|---|
| TS tensile strength ($R_m$) | 1100-1300 MPa |
| YS yield strength ($R_{p0.2}$) | 900-1100 MPa |
| YR yield ratio ($R_{p0.2}/R_m$) | ≥0.70 |
| bendability (Ri/t) | ≤3 |
| HER | ≥50. |

According to a fifth example the steel:

a) having a composition comprising of (in wt. %):

| | |
|---|---|
| C | 0.10-0.20 |
| Mn | 2.0-3.0 |
| Cr | 0.1-0.5 |
| Si | 0.2-0.9 |
| Al | 0.01-0.5 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities; and b) fulfilling at least one of the following conditions:

| | |
|---|---|
| TS tensile strength ($R_m$) | 900-1100 MPa |
| YS yield strength ($R_{p0.2}$) | 600-800 MPa |
| YR yield ratio ($R_{p0.2}/R_m$) | ≥0.65 |
| bendability (Ri/t) | ≤2.5 |
| HER | ≥30. |

According to a sixth example the steel:

a) having a composition comprising of (in wt. %):

| | |
|---|---|
| C | 0.08-0.28 |
| Mn | 1.4-4.5 |
| Cr | 0.01-0.5 |
| Si | 0.01-2.5 |
| Al | 0.5-2.0 |
| Mn + Cr | 1.7-5.0 |
| Nb | ≤0.1 |
| Ti | ≤0.1 |
| Mo | ≤0.5 |
| Ca | ≤0.05 |
| V | ≤0.1 |

balance Fe apart from impurities; and b) fulfilling at least one of the following conditions:

| | |
|---|---|
| TS tensile strength ($R_m$) | 950-1350 MPa |
| YS yield strength ($R_{p0.2}$) | 350-1150 MPa |
| YR yield ratio ($R_{p0.2}/R_m$) | ≥0.35 |
| bendability (Ri/t) | ≤4 |
| HER | ≥15 |

According to a seventh example the steel:

a) having a composition comprising of (in wt. %):

| | |
|---|---|
| C | 0.12-0.20 |
| Mn | 1.9-2.6 |
| Cr | 0.15-0.3 |
| Si | 0.3-0.8 |
| Al | 0.8-1.2 |
| Nb | ≤0.008 |
| Ti | ≤0.02 |
| Mo | ≤0.08 |
| Ca | ≤0.005 |
| V | ≤0.02 |

balance Fe apart from impurities b) fulfilling at least one of the following conditions:

| | |
|---|---|
| TS tensile strength ($R_m$) | 950-1150 MPa |
| YS yield strength ($R_{p0.2}$) | 350-600 MPa |
| YR yield ratio ($R_{p0.2}/R_m$) | ≥0.38 |
| bendability (Ri/t) | ≤4 |
| HER | ≥15. |

Example

Five steels A-E were produced by conventional metallurgy by converter melting and secondary metallurgy. The compositions are shown in table 1, further elements were present only as impurities, and below the lowest levels specified in the present description. The compositions are shown in Table 1.

TABLE 1

| Steel | C | N | Mn | Cr | Si | Al |
|---|---|---|---|---|---|---|
| A | 0.112 | 0.0057 | 2.69 | 0.217 | 0.88 | 0.057 |
| B | 0.226 | 0.0072 | 1.50 | 0.410 | 0.16 | 0.054 |
| C | 0.205 | 0.0073 | 2.54 | 0.057 | 1.46 | 0.066 |
| D | 0.158 | 0.0081 | 2.34 | 0.270 | 0.45 | 0.063 |
| E | 0.173 | 0.0053 | 2.34 | 0.260 | 0.47 | 0.930 |

The steels were continuously cast and cut into slabs. The slabs were reheated and hot rolled in austenitic range to a thickness of about 2.8 mm. The hot rolling finishing temperature was about 900° C. The hot rolled steel strips where thereafter coiled at a coiling temperature of 630° C. The coiled hot rolled strips were pickled and batch annealed at about 624° C. for 10 hours in order to reduce the tensile strength of the hot rolled strip and thereby reducing the cold rolling forces. The strips were thereafter cold rolled in a five stand cold rolling mill to a final thickness of about 1.4 mm.

The cold rolled steel strips were conveyed to a Hot Dip Galvanizing Line. The strips were heated to a temperature of 800° C. in a Non-Oxidizing Furnace in a reducing atmosphere. The strips were thereafter conveyed to a soaking furnace and soaked at temperatures and conditions according to Table 2. Each steel was soaked in an N2+1.4% H2 atmosphere as of the invention and in a reference atmosphere N2+2.5% H2. The inventive steels denoted by A1, . . . , E1, and the reference steels A2, . . . , E2.

After soaking the steels were cooled by slow jet cooling (SJC) followed by rapid jet cooling (RJC), the end temperatures for SJC and RJC are shown in Table 2. The strips were isothermal held at the end temperature rapid jet cooling at about 180 s and thereafter Hot Dip Galvanized to apply a zinc coating.

The process parameters are shown in table 2.

TABLE 2

| Steel | Soaking temp (° C.) | Soaking time (s) | Atmosphere | SJC (° C.) | RJC (° C.) | Hold time (s) |
|---|---|---|---|---|---|---|
| A1 | 850 | 120 | N2 + 1.4% H2 | 750 | 390 | 180 |
| A2 | 850 | 120 | N2 + 2.5% H2 | 750 | 390 | 180 |
| B1 | 850 | 120 | N2 + 1.4% H2 | 700 | 250 | 180 |
| B2 | 850 | 120 | N2 + 2.5% H2 | 700 | 250 | 180 |
| C1 | 850 | 120 | N2 + 1.4% H2 | 700 | 350 | 180 |
| C2 | 850 | 120 | N2 + 2.5% H2 | 700 | 350 | 180 |
| D1 | 850 | 120 | N2 + 1.4% H2 | 750 | 380 | 180 |
| D2 | 850 | 120 | N2 + 2.5% H2 | 750 | 380 | 180 |
| E1 | 850 | 120 | N2 + 1.4% H2 | 750 | 400 | 180 |
| E2 | 850 | 120 | N2 + 2.5% H2 | 750 | 400 | 180 |

The properties of the steels are shown in table 3.

The hydrogen concentration in the steels was determined and were found to be less than 0.2 ppm in the inventive steels A1, . . . , E1, whereas the reference steels A2, . . . , E2 were found to have a hydrogen concentration above 0.3 ppm.

The hydrogen concentration is less than 0.2 ppm in the steel. The dissolution of hydrogen in both ferrite and austenite has been investigated and the studies reveals that for face centred cubic crystal structure like austenite, hydrogen is favoured at octahedral sites and the dissolution energy is smaller than that in body centred cubic crystal structures like ferrite and martensite and this is the explanation for larger solubility of hydrogen in austenite than in ferrite. After punching operations, which introduce a great amount of dislocations, the hydrogen diffuses to the edges and worsens the local ductility (e.g.: HER).

The HER of the inventive steels A1, . . . , E1 are 20-50% higher than that of the reference steels A2, . . . , E2. Furthermore, the bendability is also considerably improved for inventive steels A1, . . . , E1 compared to the reference A2, . . . , E2.

The hole expansion ratio HER and the yield ratio YR for all steels were plotted in FIG. 1. As can be seen the steels are following a linear pattern, where the inventive steels have a higher HER for a similar YR. A line between the data was defined through the coordinates [0.30, 8] and [0.90, 50]. All inventive steels came above this line, whereas the reference came below.

TABLE 3

| Steel | YS $R_{p0.2}$ | TS $R_m$ | YR $R_{p0.2}/R_m$ | Unif. El JIS | Total El JIS (A50) | Ri/t | HER (λ) | Diffusable H (ppm) | $A_{c3}$ (C. °) |
|---|---|---|---|---|---|---|---|---|---|
| A1 | 862 | 1062 | 0.81 | 8.0 | 13.3 | 1.6 | 60 | <0.2 | 801 |
| A2 | 900 | 1098 | 0.87 | 6.9 | 11.5 | 2.7 | 40 | >0.3 | 801 |
| B1 | 1220 | 1531 | 0.78 | 3.9 | 6.6 | 3.5 | 57 | <0.2 | 778 |
| B2 | 1230 | 1498 | 0.82 | 3.5 | 6.0 | 4.2 | 43 | >0.3 | 778 |
| C1 | 900 | 1207 | 0.78 | 10.1 | 15.9 | 2.4 | 44 | <0.2 | 810 |
| C2 | 873 | 1221 | 0.71 | 10.6 | 16.6 | 3.3 | 32 | >0.3 | 810 |
| D1 | 730 | 1009 | 0.73 | 9.1 | 15.2 | 2.0 | 40 | <0.2 | 780 |
| D2 | 748 | 1024 | 0.73 | 9.1 | 15.4 | 2.8 | 30 | >0.3 | 780 |
| E1 | 408 | 998 | 0.41 | 12.4 | 16.2 | 3.2 | 19 | <0.2 | 777 |
| E2 | 410 | 980 | 0.41 | 12.4 | 16.3 | 4.6 | 12 | >0.3 | 777 |

Yield strength YS and tensile strength TS were derived according to the European norm EN 10002 Part 1. The samples were taken in the longitudinal direction of the strip. The total elongation ($A_{50}$) is derived in accordance with the Japanese Industrial Standard JIS Z 2241: 2011, wherein the samples are taken in the transversal direction of the strip.

Samples of the produced strips were subjected to V bend test in accordance with JIS Z2248 to find out the limiting bending radius (Ri). The samples were examined both by eye and under optical microscope with 25 times magnification in order to investigate the occurrence of cracks. Ri is the largest radius in which the material shows no cracks after three bending tests. Ri/t was determined by dividing the limiting bending radius (Ri) with the thickness of the cold rolled strip (t).

$A_{c3}$ was determined by the formula:

$$A_{c3}=910-203*C^{1/2}-15.2\ Ni-30\ Mn+44.7\ Si+104\ V+31.5\ Mo+13.1\ W.$$

All steels were soaked at more than $A_{c3}$+30° C.

The microstructures of the A1, B1, D1 and E1 was determined and are shown in Table 4.

TABLE 4

| | A1 | B1 | C1 | D1 | E1 |
|---|---|---|---|---|---|
| Bainite + Tempered Martensite | >85% | ~95% | >70% | ~85% | ~45% |
| Fresh martensite | ~5% | — | <15% | ~5% | ~20% |
| Retained austenite | ~5% | ~5% | <15% | ~10% | ~10% |
| Polygonal ferrite | — | — | — | — | ~25% |

The invention claimed is:

1. A zinc or zinc-alloy coated cold rolled steel strip or sheet, a) having a composition comprising of in wt. %:

| | |
|---|---|
| C | 0.08-0.28 |
| Mn | 1.4-4.5 |

-continued

| | |
|---|---|
| Cr | 0.01-0.5 |
| Si | 0.01-2.5 |
| Al | 0.01-2.0 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |
| Cu | 0.06% |
| Ni | 0.08% |
| B | 0.0006% |
| P[[]] | 0.02% |
| S | 0.005% |
| As | 0.010% |
| Zr | 0.006% |
| Sn | 0.015% |
| O | 0.0003 |
| N | 0.015% |

balance Fe apart from impurities;

b) fulfilling the following conditions:

| | |
|---|---|
| TS tensile strength ($R_m$) | 950-1550 MPa |
| YS yield strength ($R_{p0.2}$) | 350-1400 MPa |
| YR yield ratio ($R_{p0.2}/R_m$) | ≥0.35 |
| bendability (Ri/t) | ≤4 |
| HER hole expansion ratio (λ) | 15; |

c) having a multiphase microstructure comprising in vol % tempered martensite +

| | |
|---|---|
| bainite | ≥40 |
| fresh martensite | ≤30 |
| retained austenite | 5-20 |
| polygonal ferrite | ≤35; |

d) having a hydrogen concentration of less than 0.2 ppm of the steel;

e) having a zinc or zinc-alloy coating;

f) wherein the amount of retained austenite was measured by means of the saturation magnetization method described in detail in Proc. Int. Conf. on TRIP-aided high strength ferrous alloys (2002), Ghent, Belgium, p. 61-64;

g) wherein the bendability is determined in accordance with JIS Z2248;

h) wherein the yield strength and tensile strength are determined according to the European norm EN 10002 Part 1;

i) wherein the HER (1) is determined according to ISO/WD 16630:2009 (E).

2. The cold roll strip or sheet according to claim 1, wherein the hole expansion ratio HER, and the yield ratio YR are above the line through the coordinates A and B, where HER in % y-axle is plotted vs YR x-axle, and where A is [0.30, 8] and B is [0.90, 50].

3. The cold roll strip or sheet according to claim 1, a) having a composition comprising of in wt. %:

| | |
|---|---|
| C | 0.08-0.28 |
| Mn | 1.4-4.5 |
| Cr | 0.01-0.5 |
| Si | 0.01-2.5 |

-continued

| | |
|---|---|
| Al | 0.01-0.6 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities;

b) fulfilling at least one of the following conditions:

| | |
|---|---|
| TS tensile strength ($R_m$) | 950-1550 MPa |
| YS yield strength ($R_{p0.2}$) | 550-1400 MPa |
| YR yield ratio ($R_{p0.2}/R_m$) | ≥0.50 |
| bendability (Ri/t) | ≤4; |
| HER | ≥25 |

and c) having a multiphase microstructure comprising in vol % tempered martensite +

| | |
|---|---|
| bainite | ≥50 |
| fresh martensite | ≤10 |
| retained austenite | 5-20 |
| polygonal ferrite | ≤10. |

4. The cold roll strip or sheet according to claim 3, wherein the composition fulfilling at least one of the following conditions in wt %:

| | |
|---|---|
| C | 0.1-0.25 |
| Mn | 1.4-3 |
| Si | 0.1-1 |
| Al | 0.01-0.1 |
| Nb | ≤0.008 |
| Ti | ≤0.02 |
| Mo | ≤0.08 |
| Ca | ≤0.005 |
| V | ≤0.02 |

balance Fe apart from impurities.

5. The cold roll strip or sheet according to claim 3, a) having a composition comprising of in wt. %:

| | |
|---|---|
| C | 0.08-0.16 |
| Mn | 2.0-3.0 |
| Cr | 0.1-0.5 |
| Si | 0.5-1.2 |
| Al | 0.01-0.5 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities; and b) fulfilling at least one of the following conditions:

| | |
|---|---|
| TS tensile strength ($R_m$) | 950-1150 MPa |
| YS yield strength ($R_{p0.2}$) | 750-1000 MPa |
| YR yield ratio ($R_{p0.2}/R_m$) | ≥0.70 |

-continued

| | |
|---|---|
| bendability (Ri/t) | ≤2 |
| HER | ≥50. |

6. The cold roll strip or sheet according to claim 3, a) having a composition comprising of in wt. %:

| | |
|---|---|
| C | 0.15-0.25 |
| Mn | 1.0-2.0 |
| Cr | 0.1-0.5 |
| Si | 0.1-0.5 |
| Al | 0.01-0.5 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities; and b) fulfilling at least one of the following conditions:

| | |
|---|---|
| TS tensile strength ($R_m$) | 1300-1550 MPa |
| YS yield strength ($R_{p0.2}$) | 1000-1300 MPa |
| YR yield ratio ($R_{p0.2}/R_m$) | ≥0.70 |
| bendability (Ri/t) | ≤4 |
| HER | ≥50. |

7. The cold roll strip or sheet according to claim 3, a) having a composition comprising of in wt. %:

| | |
|---|---|
| C | 0.15-0.25 |
| Mn | 2.0-3.0 |
| Cr | 0.1-0.5 |
| Si | 1-2.0 |
| Al | 0.01-0.5 |
| Si + Al | ≥0.1 |
| Si + Al + Cr | ≥0.4 |
| Nb | ≤0.1 |
| Ti | ≤0.1 |
| Mo | ≤0.5 |
| Ca | ≤0.05 |
| V | ≤0.1 |

balance Fe apart from impurities; and b) fulfilling at least one of the following conditions:

| | |
|---|---|
| TS tensile strength ($R_m$) | 1100-1300 MPa |
| YS yield strength ($R_{p0.2}$) | 900-1100 MPa |
| YR yield ratio ($R_{p0.2}/R_m$) | ≥0.70 |
| bendability (Ri/t) | ≤3 |
| HER | ≥50. |

8. The cold roll strip or sheet according to claim 3, a) having a composition comprising of in wt. %:

| | |
|---|---|
| C | 0.10-0.20 |
| Mn | 2.0-3.0 |
| Cr | 0.1-0.5 |
| Si | 0.2-0.9 |
| Al | 0.01-0.5 |
| Si + Al | ≥0.1 |
| Si + Al + Cr | ≥0.4 |
| Nb | ≤0.1 |
| Ti | ≤0.1 |
| Mo | ≤0.5 |

-continued

| | |
|---|---|
| Ca | ≤0.05 |
| V | ≤0.1 |

balance Fe apart from impurities; and b) fulfilling at least one of the following conditions:

| | |
|---|---|
| TS tensile strength ($R_m$) | 900-1100 MPa |
| YS yield strength ($R_{p0.2}$) | 600-800 MPa |
| YR yield ratio ($R_{p0.2}/R_m$) | ≥0.65 |
| bendability (Ri/t) | ≤2.5 |
| HER | ≥30. |

9. The cold roll strip or sheet according to claim 3, wherein

Al≤0.1.

10. The cold roll strip or sheet according to claim 1, a) having a composition comprising of in wt. %:

| | |
|---|---|
| C | 0.08-0.28 |
| Mn | 1.4-4.5 |
| Cr | 0.01-0.5 |
| Si | 0.01-2.5 |
| Al | 0.5-2.0 |
| Mn + Cr | 1.7-5.0 |
| Nb | ≤0.1 |
| Ti | ≤0.1 |
| Mo | ≤0.5 |
| Ca | ≤0.05 |
| V | ≤0.1 |

balance Fe apart from impurities; and b) fulfilling at least one of the following conditions:

| | |
|---|---|
| TS tensile strength ($R_m$) | 950-1350 MPa |
| YS yield strength ($R_{p0.2}$) | 350-1150 MPa |
| YR yield ratio ($R_{p0.2}/R_m$) | ≥0.35 |
| bendability (Ri/t) | ≤4 |
| HER | ≥15 |

c) having a multiphase microstructure comprising in vol % tempered martensite +

| | |
|---|---|
| bainite | ≥40 |
| fresh martensite | 10-30 |
| retained austenite | 5-20 |
| polygonal ferrite | 10-35. |

11. The cold roll strip or sheet according to claim 10, a) having a composition comprising of in wt. %:

| | |
|---|---|
| C | 0.12-0.20 |
| Mn | 1.9-2.6 |
| Cr | 0.15-0.3 |
| Si | 0.3-0.8 |
| Al | 0.8-1.2 |
| Nb | ≤0.008 |
| Ti | ≤0.02 |
| Mo | ≤0.08 |

-continued

| | |
|---|---|
| Ca | ≤0.005 |
| V | ≤0.02 |

balance Fe apart from impurities: and b) fulfilling at least one of the following conditions:

| | |
|---|---|
| TS tensile strength ($R_m$) | 950-1150 MPa |
| YS yield strength ($R_{p0.2}$) | 350-600 MPa |
| YR yield ratio ($R_{p0.2}/R_m$) | ≥0.38 |
| bendability (Ri/t) | ≤4 |
| HER | ≥15. |

12. A method of producing a zinc or zinc-alloy coated steel strip or sheet according to claim 1 comprising the following steps:

i. providing the cold rolled steel sheet or strip, the cold rolled strip produced by making steel slabs of the conventional metallurgy by converter melting and secondary metallurgy, rolling the slab completely in the austenitic range wherein the hot rolling finishing temperature is greater than or equal to 850° C., coiling the hot rolled strip in the range of 500-700° C., batch annealing the coiled strip in the range of 500-650° C. for a duration of 5-30h, cold rolling the batch annealed steel strip with a reduction rate between 35 and 90%;

ii. heating the sheet or strip to a temperature in the range of 650-900° C. in a reducing atmosphere with an optional change of atmosphere to an oxidizing atmosphere in a temperature range lying between 650 and 900° C.;

iii. soaking the sheet or strip at temperature in the range of 780-1000° C. for a duration of 40 s to 180 s in a nitrogen atmosphere containing <2 vol. % hydrogen iv. cooling the strip or sheet at a rate in the range of 10-400° C./s to a temperature between 200 and 500° C. followed by isothermal holding for 50-10000 s before coating;

v. coating the strip or sheet with a zinc or a zinc-alloy coating; and vi. optionally galvannealing to alloy the coating into the steel strip or sheet.

13. The method according to claim 12, wherein the soaking temperature in step iii) is in the range of 830-890° C.

14. The method according to claim 12, wherein the soaking temperature in step iii) is above $A_{c3}$ as defined by: $A_{c3}=910-203*C^{1/2}-15.2\ Ni-30\ Mn+44.7\ Si+104\ V+31.5\ Mo+13.1\ W$.

15. The method according to claim 14, wherein the soaking temperature in step iii) is above $A_{c3}+20°$ C.

* * * * *